US006296060B1

(12) United States Patent
McCaslin

(10) Patent No.: US 6,296,060 B1
(45) Date of Patent: Oct. 2, 2001

(54) METHODS AND SYSTEMS FOR PRODUCING OFF-SHORE DEEP-WATER WELLS

(75) Inventor: Kurt P. McCaslin, Spring, TX (US)

(73) Assignee: Kerr-McGee Corporation, Oklahoma City, OK (US)

( * ) Notice: Subject to any disclaimer, the term of this patent is extended or adjusted under 35 U.S.C. 154(b) by 0 days.

(21) Appl. No.: 09/479,490

(22) Filed: Jan. 10, 2000

(51) Int. Cl.[7] ..... C07C 9/00; E21B 43/00
(52) U.S. Cl. ..... 166/357; 166/267; 385/15
(58) Field of Search ..... 585/15; 166/335, 166/369, 265, 267, 357

(56) References Cited

U.S. PATENT DOCUMENTS

| | | | | |
|---|---|---|---|---|
| 3,514,274 | | 5/1970 | Cahn et al. | 48/190 |
| 3,975,167 | | 8/1976 | Nierman | 48/190 |
| 4,147,456 | | 4/1979 | Klass | 405/210 |
| 4,393,660 | | 7/1983 | Kleiner et al. | 62/69 |
| 4,404,807 | | 9/1983 | Zemelman et al. | 62/1 |
| 5,473,904 | | 12/1995 | Guo et al. | 62/46.1 |
| 5,613,362 | | 3/1997 | Dixon | 60/649 |
| 5,950,732 | * | 9/1999 | Agee et al. | 166/354 |
| 6,028,234 | * | 2/2000 | Heinemann et al. | 585/15 |
| 6,111,155 | * | 8/2000 | Williams et al. | 585/15 |

* cited by examiner

*Primary Examiner*—William Neuder
(74) *Attorney, Agent, or Firm*—C. Clark Dougherty, Jr.

(57) ABSTRACT

Methods of placing off-shore wells on production comprising the steps of separating a gas from oil or oil and water produced by the well, introducing the gas into the seawater surrounding the well at a depth where the temperature and pressure of the seawater are such that solid gas hydrates are formed when the gas is mixed with the seawater, mixing the gas with the seawater whereby the gas is converted to solid gas hydrates and depositing the solid gas hydrates on the sea floor.

26 Claims, 3 Drawing Sheets

METHODS AND SYSTEMS FOR PRODUCING OFF-SHORE DEEP-WATER WELLS

BACKGROUND OF THE INVENTION

1. Field of the Invention.

The present invention relates to methods and systems for producing off-shore deep-water oil and gas wells where gas pipelines or other gas handling facilities are unavailable.

2. Description of the Prior Art.

In undeveloped off-shore deep-water areas, there are generally no gas production pipelines or processing facilities available. As a result, the developer of such areas must either pay the high cost of building pipelines to far away existing gas and oil processing facilities or build expensive floating processing and off-loading facilities for oil and gas products.

Without pipeline infrastructure, the handling of natural gas off-shore is especially difficult because it must be converted to a liquid form and transported by tanker vessel or the like. The alternatives available are to convert the natural gas to liquefied natural gas, to methanol or to a liquid hydrocarbon mixture using the Fischer-Tropsch process. All of these natural gas liquification methods involve the construction of expensive and complex off-shore processing facilities.

Processing facilities known as "early production systems" have heretofore been utilized to produce smaller off-shore deep-water fields as well as to place wells in large fields on production whereby operating parameter data can be developed for use in designing large scale pipeline and processing facilities. However, such early production systems have heretofore been very expensive and often cost more money to operate than they produce. In addition, most early production systems currently in use flare the natural gas rather than processing it which is not permitted in the Gulf of Mexico and other off-shore deep-water areas.

Thus, there is a need for a simple and relatively inexpensive production system whereby natural gas can be produced in an inexpensive environmentally safe manner and the oil or oil and water produced with the natural gas can be separated and transported to processing facilities by way of tanker vessels or the like.

SUMMARY OF THE INVENTION

The present invention provides methods of placing off-shore gas producing wells on production which meet the needs described above and overcome the deficiencies of the prior art. The methods of the invention are basically comprised of the steps of separating gas produced by an off-shore well from oil or oil and water produced by the well, introducing the gas into the water surrounding the well at a depth where the temperature and pressure of the water are such that solid gas hydrates are formed when the gas is mixed with the water, mixing the gas with water whereby the gas is converted to solid gas hydrates and depositing the solid gas hydrates on the sea floor.

The oil or oil and water separated from the produced gas can be deposited in a floating container such as a tanker vessel for transport to a processing or pipeline facility. The apparatus for separating the gas from oil or oil and water produced by the well, i.e., a gas-liquid separator; a gas compressor for elevating the pressure of the gas, if required; and piping and the like can also be mounted on the tanker vessel. Also, if considerable water is produced, the water can be separated from the oil, treated in a water treating unit to make it environmentally acceptable and disposed of in the water surrounding the well. In order to provide excess water for carrying the solid gas hydrates formed, a water pump can be provided on the tanker vessel for pumping water from a depth where the temperature of the water is such that solid gas hydrates are formed when gas is mixed with the water. A reactor vessel for mixing the gas with the water is provided to insure that the gas fully reacts with the water and forms solid gas hydrates. The reactor vessel can be located on the tanker vessel or it can be located at the end of a conduit at the depth where the pressure and temperature are suitable for the formation of solid gas hydrates.

In an alternate embodiment of the apparatus of the invention, the entire system for separating the gas from oil or oil and water produced by the well, pumping water at a pressure and temperature suitable for forming gas hydrates and mixing the gas and water can be located on the sea floor. This arrangement can be used in locations where the oil or oil and water produced can be conducted to a nearby oil or oil and water pipeline or processing facility.

In yet another arrangement of the apparatus, a spar buoy or similar floating structure which contains a water pump and reactor vessel is connected to the well. A tanker vessel having a gas-liquid separator and compressor, if required, mounted thereon is connected to the spar buoy or floating structure whereby the gas is separated from produced oil or oil and water. The produced oil or oil-water mixture is deposited in the tanker and the separated gas is then compressed, if required, and conducted to the reactor vessel. The water pump in the floating structure is operated to provide water to the reactor vessel and the solid gas hydrates produced are conducted to near the sea floor so that the solid gas hydrates are deposited on the sea floor. Upon becoming fully loaded, the tanker vessel can off load to a shuttle tanker or disconnect from the floating structure and transport the oil or oil and water to a processing or pipeline facility while another tanker vessel equipped with the same apparatus takes its place.

It is, therefore, a general object of the present invention to provide improved methods and systems for economically producing off-shore deep-water gas wells.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 5 is a side elevational view schematically showing yet another alternate embodiment of the system of the present invention which includes a floating spar buoy and a tanker vessel.

DESCRIPTION OF PREFERRED EMBODIMENTS

As mentioned above, the present invention provides methods and systems for placing an off-shore gas producing well on production when the well is located in a deep-water area where gas pipeline facilities or gas processing facilities are unavailable. While the oil or oil and water produced by the well can be economically transported in tanker vessels, barges or the like to far away pipelines or processing facilities, natural gas produced by the well can not. That is, in order to transport the produced natural gas, highly expensive process facilities for converting the gas to a liquid must be constructed at the well site.

In accordance with the present invention, the gas produced by a well located as described above is separated and converted to solid gas hydrates which are deposited on the sea floor. The oil or oil and water produced is deposited in a tanker vessel, barge, floating storage tank or the like and transported to the closest pipeline or processing facility. The gas hydrates stored on the sea floor can later be recovered such as by the system and method described in U.S. Pat. No. 5,950,732 issued on Sept. 14, 1999 to Agee et al. or other similar system and method.

Gas hydrates are clathrate compounds formed by natural gas and water. The gas hydrate compounds formed are crystalline solids and are insoluble in water. They usually form only at high pressures and low temperatures. When a well is drilled in a deep-water off-shore lake, sea or ocean environment, all of the necessary conditions and components exist for the formation of solid gas hydrates, i.e., the water from the lake, sea or ocean, high pressure gas from the well and low temperatures in the deepwater. Gas hydrates readily disassociate into water and hydrocarbons when they are exposed to lower pressures and/or higher temperatures. The term "seawater" is used hereinafter to mean salt water, desalinated water or fresh water from oceans, seas, lakes or the like.

Figure 1:
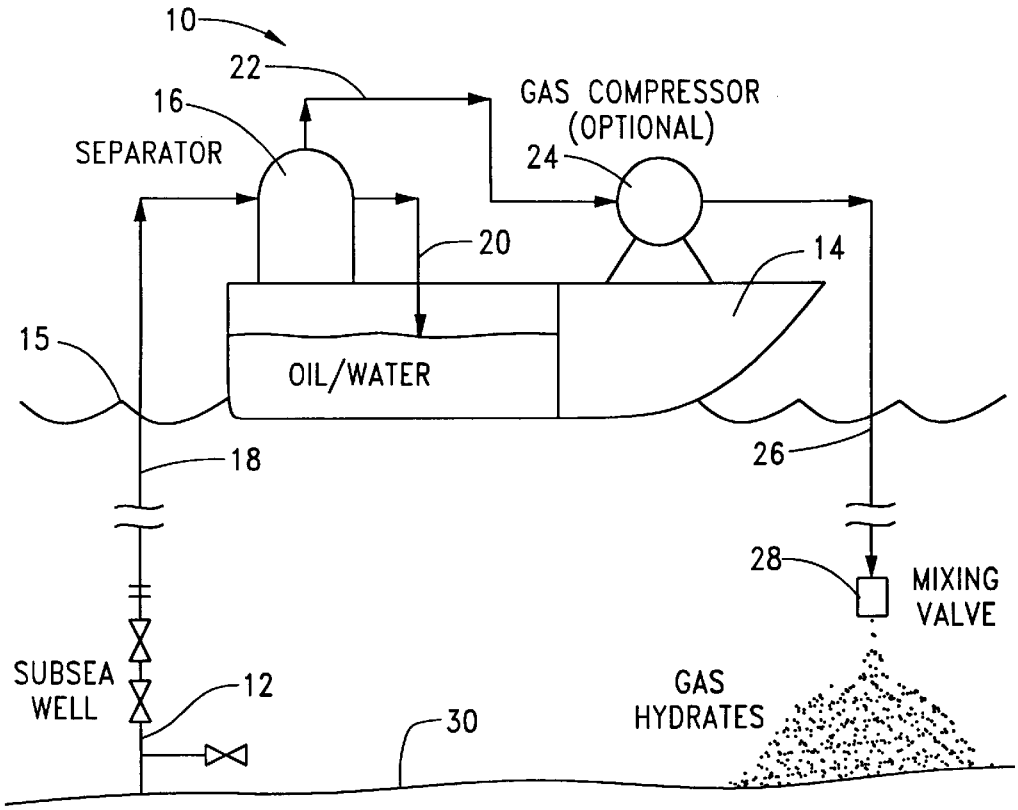
FIG. 1 is a side elevational view schematically showing a well and a system of the present invention which utilizes a tanker vessel.

The methods and systems of the present invention will be readily understood by those skilled in the art by referring to the drawings where like numerals are used for like and corresponding parts of the various systems shown. Referring to FIG. 1, a system of this invention, generally designated by the numeral 10, is illustrated connected to an off-shore sub-seawater gas producing well 12 which may also produce oil or oil and water. The system 10 is comprised of a tanker vessel or the like 14 on the surface 15 of the seawater above the subsea well 12. The tanker vessel 14 includes a gas-liquid separator 16 mounted thereon which is connected to the subsea well 12 by a conduit 18. The conduit 18 is made up of various parts including a flexible hose (not shown) which allows the tanker vessel to be moved by wave action on the surface 15 without disconnecting from the well 12. The separator 16 functions to separate produced natural gas from oil or oil and water produced with the gas. The separated oil or oil-water mixture is deposited in the tanker vessel 14 by a conduit 20 connected to the separator 16 and the separated gas flows from the separator 16 into a conduit 22. If large amounts of water are produced, the water can be separated from produced oil, treated in a water treating unit (not shown) mounted on the tanker vessel 14 and disposed of in the seawater surrounding the well 12.

Depending on the flowing pressure of the well, the pressure of the gas may have to be increased so that it will have the pressure necessary to form solid gas hydrates with seawater mixed therewith. When required, a gas compressor 24 is mounted on the tanker vessel 14 and the conduit 22 is connected to the inlet of the gas compressor 24. The discharge of the gas compressor 24 is connected to a conduit 26 which extends into the seawater and below the surface thereof. The conduit 26 conducts the gas from the separator 16 or from the gas compressor 24, if used, to a depth in the seawater where the temperature and pressure of the seawater are such that solid gas hydrates will form when the gas is mixed with the seawater. A mixing valve 28 or similar device for intimately contacting and reacting the gas with seawater is connected to the bottom of the conduit 26 so that the discharged gas forms solid gas hydrates. One form of the mixing valve 28 is backpressure valve which includes means for causing the gas to contact the seawater in the form of fine bubbles and to readily mix therewith, e.g., a sparger or the like. As shown in FIG. 1, the solid gas hydrates formed settle downwardly from the mixing valve 28 by gravity and accumulate on the sea floor 30.

Thus, a method of the present invention for placing an off-shore sub-seawater gas producing well on production without the need for pipeline or processing facilities close to the well, flaring the gas, converting the gas to a liquid or the like is comprised of the steps of separating the produced natural gas from oil or oil and water produced by the well, introducing the gas into the seawater surrounding the well at a depth where the temperature and pressure of the seawater are such that solid gas hydrates are formed when the gas is mixed with the seawater, mixing the gas with the seawater whereby the gas is converted to solid gas hydrates and depositing the solid gas hydrates on the sea floor. The produced oil or oil-water mixture is deposited in the tanker vessel 14 until it becomes filled at which time the tanker 14 can be off loaded to a shuttle tanker or disconnected from the conduit 18 and subsea well 12 and replaced by another tanker vessel equipped as described above. The filled tanker vessel or shuttle tanker transports the oil or oil and water to the closest pipeline or processing facility whereupon it returns to the well and repeats the cycle. As mentioned above, when large amounts of water are produced, the water can be separated from produced oil, treated on the tanker vessel and disposed of in the seawater.

Figure 2:
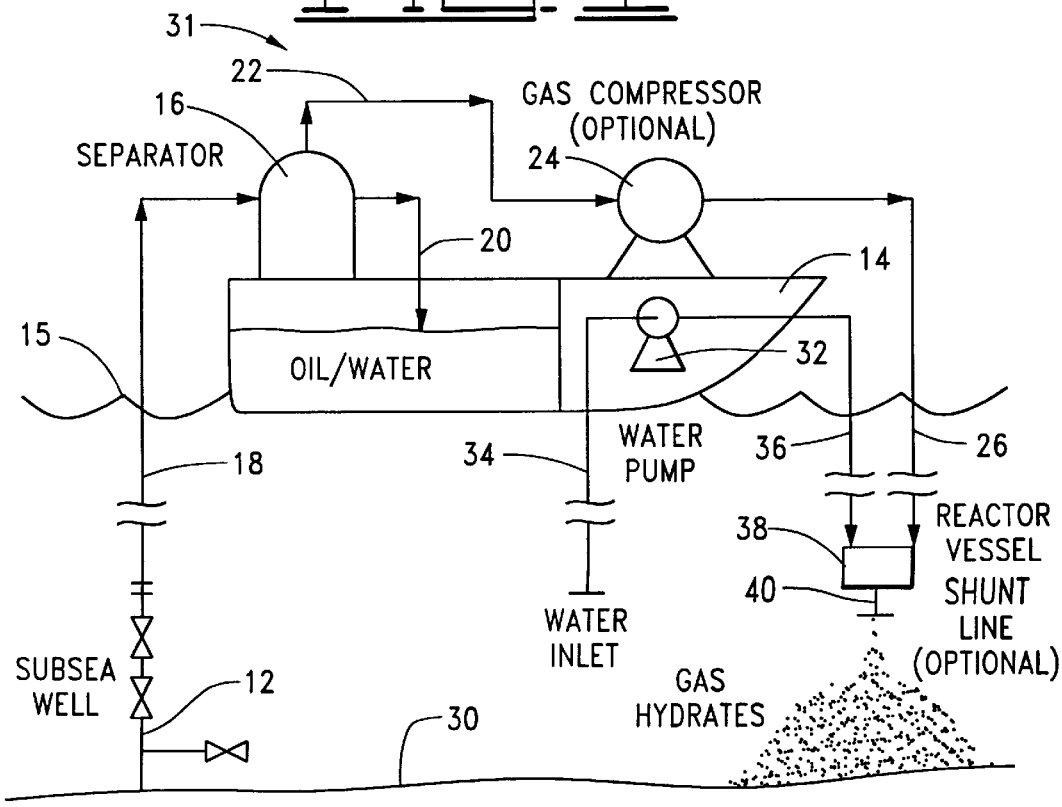
FIG. 2 is a side elevational view similar to FIG. 1 schematically showing a different embodiment of the system of the present invention.

Referring now to FIG. 2 an alternate embodiment of the present invention is illustrated. That is, the system of apparatus illustrated in FIG. 2 is similar to the system shown in FIG. 1 in that the subsea well 12 is connected to the separator 16 mounted on the tanker vessel 14 by the conduit 18. The oil or oil-water mixture separated in the separator 16 is deposited by the conduit 20 in the tanker vessel 14. The conduit 22 conducts the separated gas to the compressor 24, if required, and the conduit 26 connected to the compressor 24 conducts the gas through the seawater to a depth where the temperature and pressure of the seawater are such that solid gas hydrates are formed when the gas is mixed with the seawater. Instead of mixing the natural gas in the open seawater at the above mentioned seawater depth, a water pump 32 is utilized to draw an excess amount of seawater from the above mentioned depth and mix that water with the natural gas in a reactor vessel 38 also at the above mentioned depth. The excess seawater functions as a carrier for the solid gas hydrates formed whereby the hydrates can be caused to flow with the excess seawater through an additional conduit or shunt line 40.

Still referring to FIG. 2, the water pump 32 is mounted on the tanker vessel 14 for pumping seawater. A conduit 34, which is preferably insulated, is provided extending from a depth in the seawater having the temperature required for the formation of hydrates to the inlet connection of the water pump 32. A conduit 36 extends from the discharge of the water pump 32 to the reactor vessel 38. The shunt line 40 is optionally connected to the reactor vessel 38 to conduct the gas hydrates formed and excess water to the sea floor 30 as illustrated in FIG. 2.

The reactor vessel 38 functions similarly to the mixing valve 28 except that the reactor vessel 38 mixes the gas and seawater streams internally and discharges a stream of seawater having solid gas hydrates therein into the shunt line 40. The excess seawater present carries the gas hydrates through the shunt line 40 and deposits them on the sea floor 30. As will be understood by those skilled in the art, the reactor vessel 38 can include internal baffles or other means for intimately mixing the gas and seawater.

Thus, the method of the present invention carried out in the system 31 shown in FIG. 2 includes the steps of separating produced natural gas from oil or oil and water produced by the subsea well 12; pumping seawater to the seawater surface 15 from a depth where the temperature of the seawater is such that solid gas hydrates are formed when gas is mixed with the seawater, the seawater being pumped at a rate in excess of the rate required for converting all of the natural gas to solid gas hydrates; mixing the gas with the pumped seawater whereby the gas is converted to solid gas hydrates and the gas hydrates are carried by the excess seawater present; and depositing the solid gas hydrates carried by the excess seawater on the sea floor. The produced oil or oil-water mixture is deposited in the tanker vessel 14, or as mentioned above when large amounts of water are produced, the water can be separated from produced oil, treated and disposed of in the seawater.

Figure 3:
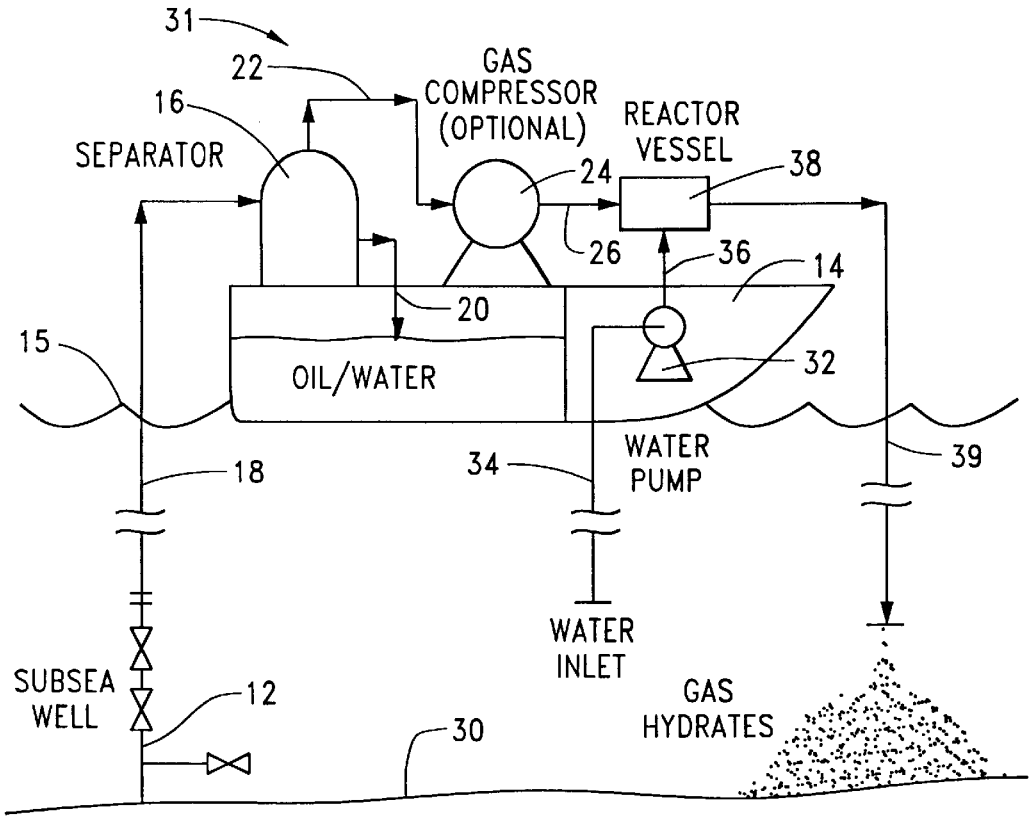
FIG. 3 is a side elevational view similar to FIG. 1 schematically showing another different embodiment of the system of the present invention.

Referring now to FIG. 3, another embodiment of the present invention generally designated by the numeral 41 is illustrated. The system 41 is identical to the system 31 described above and shown in FIG. 2 except that the reactor vessel 38 is mounted on the tanker vessel 14 instead of being disposed in the seawater. That is, the discharge conduit 36 connected to the seawater pump 32 is connected to the reactor vessel 38 which is mounted on the tanker vessel 14 and the gas discharge conduit 26 connected to the gas compressor 24, if used, is connected to the reactor vessel 38. The excess water and solid gas hydrates formed or partially formed in the reactor vessel 38 flow through a conduit 39 connected to the reactor vessel 38 and are discharged from the conduit 39 at a depth in the seawater whereby the gas hydrates formed are deposited on the sea floor 30.

Thus, the method of the present invention carried out in the system 41 illustrated in FIG. 3 is identical to the system 31 illustrated in FIG. 2 except that the reactor vessel 38 is on the seawater surface 15 instead of beneath the surface of the seawater. This allows the reactor vessel 38 to be more accessible for maintenance and clean-out as required.

Figure 4:
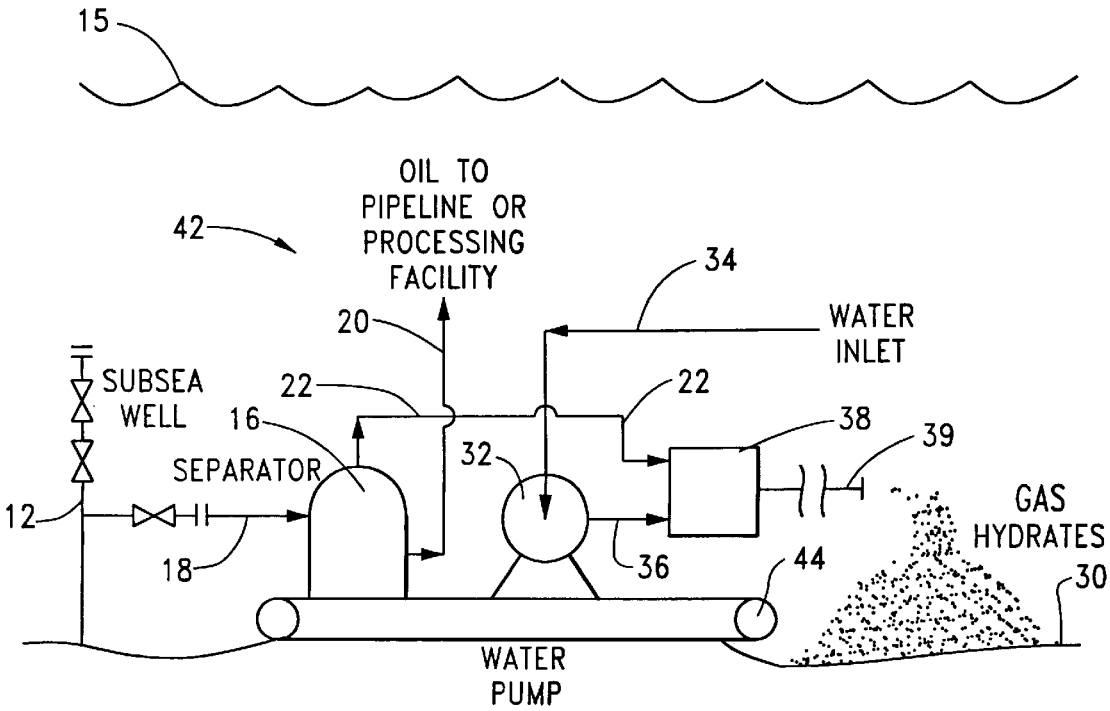
FIG. 4 is a side elevational view schematically showing a well and an alternate embodiment of the system of the present invention located under water.
Figure 3:
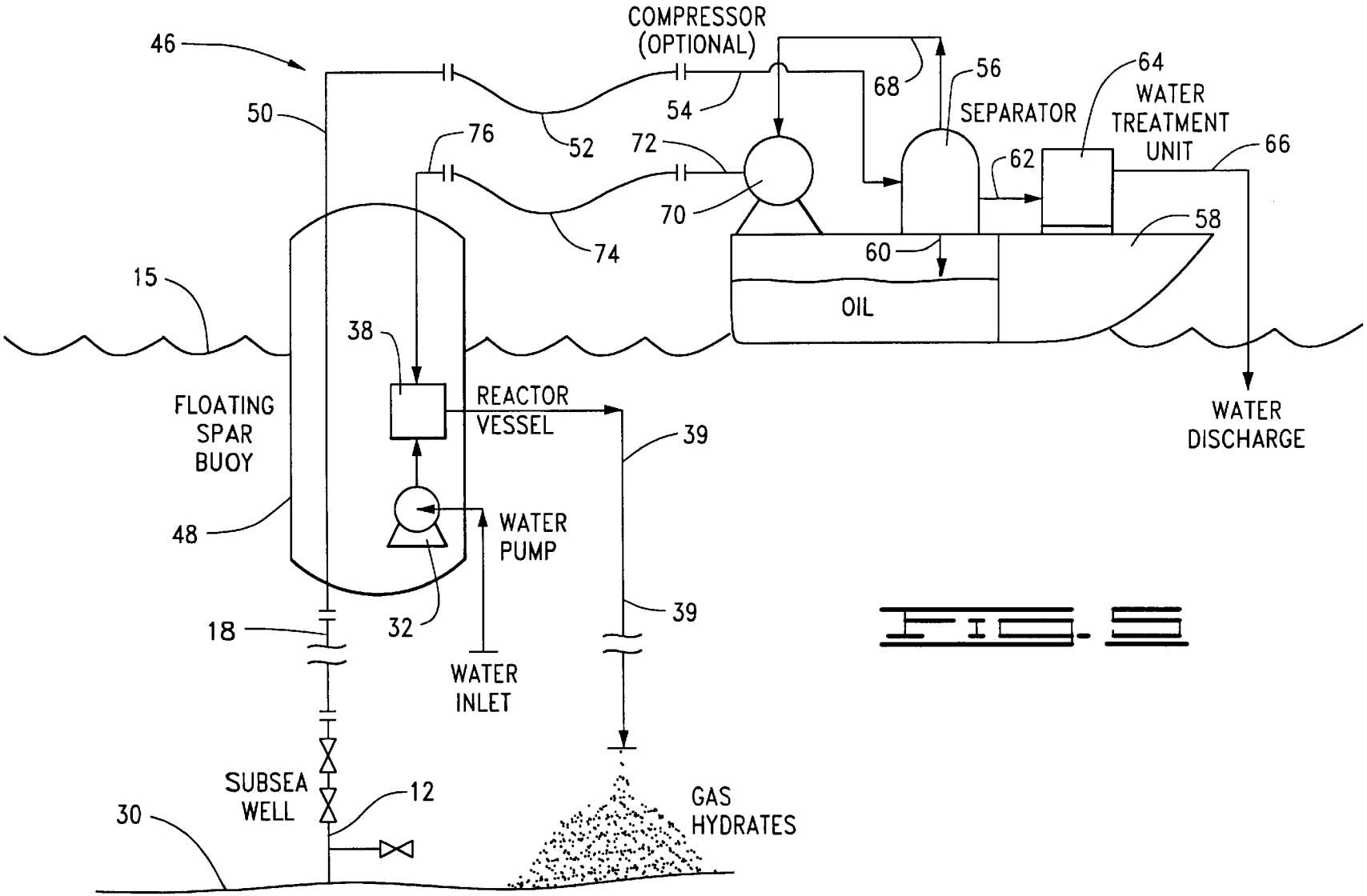

Referring now to FIG. 4, yet another embodiment of the present invention is illustrated and generally designated by the numeral 42. The system 42 is similar to the system 41 shown in FIG. 3. As shown in FIG. 4, the system 42 is placed on the sea floor, and is generally only practical when an oil or oil and water pipeline or processing facility is close by whereby the oil or oil and water can be relatively inexpensively conducted from the system 42 to the pipeline or processing facility. The system 42 includes a skid or the like 44 having the gas-liquid separator 16, the water pump 32 and the reactor vessel 38 mounted thereon. The subsea well 12 is connected to the separator 16 by the conduit 18. Oil or an oil-water mixture separated in the separator 16 is conducted to a pipeline or processing facility by the conduit 20. Natural gas separated in the separator 16 is conducted by the conduit 22 to the reactor vessel 38. The water inlet conduit 34 is connected to the water pump 32 and the discharge conduit 36 is connected between the pump 32 and the reactor vessel 38.

The conduit 39 is connected to the reactor vessel 38 which discharges solid gas hydrates on the sea floor 30.

Thus, the method carried out in the system 42 is essentially the same as the method carried out by the system 41 illustrated in FIG. 3 except that the separator, water pump and reactor vessel are all located on the sea floor and a tanker vessel is not involved. While an optional gas compressor is not illustrated in FIG. 4, if a gas compressor was required, it could also be mounted on the skid 44. However, since gas compressors are relatively complex and require high levels of maintenance, the system 41 may be more practical than the system 42 if gas compression is required.

Referring now to FIG. 5, still another embodiment of the present is illustrated and designated by the numeral 46. The system 46 is also similar to the system 41 illustrated in FIG. 3 except that the well 12 is connected to a floating spar buoy or other floating structure 48 within which the water pump 32 and the reactor vessel 38 are mounted. The conduit 18 is connected between the well 12 and a conduit 50 which extends through the floating spar buoy 48. One end of a flexible hose 52 is connected to the conduit 50 and the other end is connected to a conduit 54 mounted on a tanker vessel 58. The conduit 54 is connected to a three-phase separator 56 mounted on a tanker vessel 58. The three-phase separator 56 separates the natural gas, oil and water produced by the well 12 from each other. The separated oil is deposited by way of a conduit 60 connected to the separator 56 into the tanker vessel 58. The separated water is conducted from the separator 56 by a conduit 62 to a water treatment unit 64 which treats the water to make it environmentally acceptable for disposal into seawater. The treated water is conducted from the water treatment unit 64 to the seawater by a water discharge conduit 66. The separated natural gas is conducted from the separator 56 by a conduit 68 to an optional gas compressor 70. From the gas compressor 70, the separated gas flows by way of a conduit 72 attached to the compressor 70 to a flexible hose 74 which is connected to a conduit 76 attached to the spar buoy 48. The conduit 76 is connected to the reactor vessel 38 mounted within the spar buoy 48. The water pump 32 mounted within the spar buoy 48 draws seawater from the appropriate depth by way of the conduit 34 and pumps it into the reactor vessel 38 whereby the natural gas and seawater are mixed and solid gas hydrates are formed. The solid gas hydrates and excess seawater flow from the reactor vessel 38 by way of a conduit 39 to the required depth in the seawater from where the gas hydrates are deposited on the sea floor 30.

The method carried out in the system 46 comprises the steps of separating gas, oil and water from the gas, oil and water stream produced by the subsea well 12; pumping seawater from a depth where the temperature of the seawater is such that solid gas hydrates are formed when the gas is mixed with the seawater, the seawater being pumped at a rate in excess of the rate required for converting all of the gas to solid gas hydrates; mixing the gas with the seawater whereby the gas is converted to solid gas hydrates and the gas hydrates are carried by the excess seawater present to a depth where the pressure and temperature of the seawater are such that solid gas hydrates are formed; and then depositing the solid gas hydrates carried by the excess seawater on the sea floor. The separated oil is deposited in the tanker vessel 58 and the separated water is treated and then deposited into the seawater surrounding the tanker vessel 58.

As will be understood by those skilled in the art, various chemical additives can be combined with the seawater mixed with the natural gas in the reactor vessel to enhance the formation of hydrates therein. As mentioned above, if it is necessary to facilitate the formation of hydrates, the seawater utilized can be partially or totally desalinated prior to mixing it with the natural gas.

Thus, the methods and systems of the present invention are well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of placing an off-shore sub-seawater producing well on production comprising the steps of:

(a) separating gas from oil or oil and water produced by said well;

(b) introducing said gas into the seawater surrounding said well at a depth where the temperature and pressure of said seawater are such that solid gas hydrates are formed when said gas is mixed with said seawater;

(c) mixing said gas with seawater whereby said gas is converted to solid gas hydrates; and (d) depositing said solid gas hydrates directly on the sea floor.

2. The method of claim 1 wherein said oil or oil and water separated in accordance with step (a) are deposited in a floating container for subsequent transport to an oil or oil and water processing facility or pipeline facility.

3. The method of claim 2 wherein said floating container is a tanker vessel, a barge or a steel storage tank.

4. The method of claim 1 wherein the separation of said gas from said oil or oil and water in accordance with step (a) is carried out by a gas-liquid separator located at the surface of said seawater.

5. The method of claim 4 wherein said gas-liquid separator is located on a tanker vessel and said separated oil or oil and water are deposited in said tanker vessel.

6. The method of claim 4 wherein the pressure of said gas separated in accordance with step (a) is elevated by a gas compressor prior to when said gas is introduced into said seawater in accordance with step (b).

7. The method of claim 6 wherein said gas compressor is located at the surface of said seawater.

8. The method of claim 7 wherein said gas compressor is located on a tanker vessel along with a gas-liquid separator for carrying out step (a).

9. The method of claim 4 wherein said gas is introduced into said seawater in accordance with step (b) by way of a conduit extending from said gas-liquid separator or optionally from a gas compressor connected to said gas-liquid separator to said depth in said seawater.

10. The method of claim 9 wherein said mixing of said gas with said seawater in accordance with step (c) is performed by a mixing valve attached to said conduit.

11. A method of placing an off-shore sub-seawater gas producing well on production comprising the steps of:

(a) separating said gas from oil or oil and water produced by said well;

(b) pumping seawater from a depth where the temperature of the seawater is such that solid gas hydrates are formed when said gas is mixed with said seawater, said seawater being pumped at a rate in excess of the rate required for converting all of said gas to solid gas hydrates;

(c) mixing said gas with said seawater whereby said gas is converted to solid gas hydrates and the gas hydrates are carried by the excess seawater present; and (d) depositing said solid gas hydrates carried by said excess seawater directly on the sea floor.

12. The method of claim 11 wherein said oil or oil and water separated in accordance with step (a) are deposited in a floating container for subsequent transport to an oil or oil and water processing facility or pipeline facility.

13. The method of claim 12 wherein said floating container is a tanker vessel, a barge or a steel storage tank.

14. The method of claim 11 wherein the separation of said gas from said oil or oil and water in accordance with step (a) is carried out by a gas-liquid separator located at the surface of said seawater.

15. The method of claim 14 wherein said gas-liquid separator is located on a tanker vessel and said separated oil or oil and water are deposited in said tanker vessel.

16. The method of claim 14 wherein the pressure of said gas separated in accordance with step (a) is elevated by a gas compressor prior to when said gas is mixed with said seawater in accordance with step (c).

17. The method of claim 16 wherein said gas compressor is located at the surface of said seawater.

18. The method of claim 11 wherein the pumping of said seawater in accordance with step (b) is carried out by a seawater pump having a suction conduit connected thereto extending through said seawater to said depth.

19. The method of claim 18 wherein said mixing of said gas in accordance with step (c) is performed in a reactor vessel connected to said seawater pump by a discharge conduit extending between said pump and said reactor vessel and connected to said gas-liquid separator by a gas conduit extending between said separator and said reactor vessel.

20. The method of claim 19 wherein said seawater pump and said reactor vessel are located on the surface of said seawater.

21. The method of claim 19 wherein said seawater pump is located on the surface of said seawater and said reactor vessel is located below the surface of said seawater.

22. The method of claim 11 which further comprises the steps of:

(e) separating water from the oil and water separated from said gas in accordance with step (a);

(f) treating said separated water to make it environmentally acceptable; and (g) discharging the treated separated water produced in step (f) into said seawater.

23. The method of claim 11 wherein the separation of said gas from said oil or oil and water in accordance with step (a) is carried out by a gas-liquid separator on the sea floor.

24. The method of claim 23 wherein said oil or oil and water separated in accordance with step (a) are conducted to a subsea pipeline facility or a subsea oil and water processing facility.

25. The method of claim 24 wherein the pumping of said seawater in accordance with step (b) is carried out by a seawater pump located on the sea floor having a suction conduit connected thereto extending through said seawater to said depth.

26. The method of claim 25 wherein said mixing of said gas in accordance with step (c) is performed by a reactor vessel located on the sea floor connected to said seawater pump by a discharge conduit extending between said pump and said reactor vessel and connected to said gas-liquid separator by a gas conduit extending between said separator and said reactor vessel.

* * * * *